US007584908B2

(12) United States Patent
Swan et al.

(10) Patent No.: US 7,584,908 B2
(45) Date of Patent: Sep. 8, 2009

(54) SPRAY NOZZLE APPARATUS AND METHOD

(75) Inventors: Trevor W. B. Swan, Cambridgeshire (GB); Simon J. Waddelow, Cambs (GB); Mark Mohr, Lindstrom, MN (US)

(73) Assignee: Sta-Rite Industries, LLC, Delavan, WI (US)

( * ) Notice: Subject to any disclaimer, the term of this patent is extended or adjusted under 35 U.S.C. 154(b) by 338 days.

(21) Appl. No.: 11/260,879

(22) Filed: Oct. 27, 2005

(65) Prior Publication Data

US 2007/0095956 A1 May 3, 2007

(51) Int. Cl.

| | |
|---|---|
| ***B05B 1/14*** | (2006.01) |
| ***B05B 1/26*** | (2006.01) |
| ***F23D 14/68*** | (2006.01) |
| ***E03C 1/08*** | (2006.01) |
| ***A62C 31/02*** | (2006.01) |

(52) U.S. Cl. ..... 239/590; 239/419.5; 239/428.5; 239/462; 239/523; 239/601; 239/DIG. 23

(58) Field of Classification Search ..... 239/418, 239/419.5, 425.5, 428.5, 431, 432, 434, 523, 239/575, 600, 601, 461, 462, 589, 590, DIG. 23
See application file for complete search history.

(56) References Cited

U.S. PATENT DOCUMENTS

| | | | |
|---|---|---|---|
| 877,178 | A | 1/1908 | Donovan et al. |
| 1,092,674 | A | 4/1914 | Tinkham |
| 1,177,884 | A | 4/1916 | Molesta et al. |
| 1,364,141 | A | 1/1921 | Reams |
| 1,380,769 | A | 6/1921 | Carlson |
| 1,526,065 | A | 2/1925 | Herstorm |
| 1,831,603 | A | 11/1931 | Macomber |
| 1,837,575 | A | 12/1931 | Munz |
| 1,936,413 | A | 11/1933 | Stillson |
| 1,964,269 | A | 6/1934 | Munz |
| 2,242,680 | A | 5/1941 | Schacht |
| 2,484,577 | A | 11/1949 | Murphy |
| 2,605,140 | A | 7/1952 | Bartling |
| 2,618,511 | A | 11/1952 | Wahlin |
| 2,626,836 | A | 1/1953 | Herron |
| 2,785,005 | A | 3/1957 | Thompson |
| 2,864,652 | A | 12/1958 | O'Brien et al. |
| 2,903,190 | A | 9/1959 | Le Deit |
| 2,997,244 | A | 8/1961 | Demaison |

(Continued)

FOREIGN PATENT DOCUMENTS

| | | |
|---|---|---|
| EP | 0329449 | 8/1989 |

(Continued)

*Primary Examiner*—Len Tran
*Assistant Examiner*—Ryan Reis
(74) *Attorney, Agent, or Firm*—Greenberg Traurig, LLP

(57) ABSTRACT

Spray nozzle apparatus and method. The apparatus can include a body, a spray orifice, a filter, and an insert. The body can have a spray outlet portion. The spray outlet portion can terminate in a spherical dome. The spray orifice can be included in the spray outlet portion and positioned before the spherical dome in a flow path. The spray orifice can be substantially V-shaped. The insert can be positioned at least partially in the spray outlet portion and can include an entry shaft having a substantially rectangular cross section and at least one projection.

34 Claims, 5 Drawing Sheets

U.S. PATENT DOCUMENTS 3,082,961 A 3/1963 Hruby, Jr.
3,085,754 A 4/1963 Thompson
3,270,966 A 9/1966 Ackley
3,342,423 A 9/1967 Hruby, Jr. et al.
3,394,888 A 7/1968 Dasse et al.
3,561,680 A 2/1971 Ott
3,675,855 A 7/1972 Harwood et al.
3,762,650 A 10/1973 Radecki
3,927,162 A 12/1975 Stalter, Sr.
3,935,896 A 2/1976 Tegtmeier et al.
4,058,262 A 11/1977 Burnham
4,130,247 A 12/1978 Healy
4,202,499 A 5/1980 Mathews
4,280,562 A 7/1981 Glinecke
4,285,470 A 8/1981 Roth
4,347,979 A 9/1982 Mathews
4,353,508 A 10/1982 Butterfield
4,591,099 A 5/1986 Emory
4,625,917 A 12/1986 Torney
4,811,903 A 3/1989 Okuma
4,828,182 A * 5/1989 Haruch ..... 239/432
4,836,449 A 6/1989 Hunter
4,899,937 A * 2/1990 Haruch ..... 239/289
4,925,097 A 5/1990 Corrigan
5,037,032 A 8/1991 Graef
5,055,003 A 10/1991 Svensson
5,083,709 A 1/1992 Iwanowski
5,108,034 A 4/1992 Huey et al.
5,119,989 A 6/1992 Kamis
5,133,502 A 7/1992 Bendig et al.
5,190,222 A 3/1993 Haruch
5,199,649 A 4/1993 Tolboll
5,275,340 A 1/1994 Haruch
5,333,790 A 8/1994 Christopher
5,333,794 A * 8/1994 Haruch ..... 239/600
D354,545 S 1/1995 Haruch
5,564,448 A * 10/1996 Lincoln ..... 134/166 R
5,873,999 A * 2/1999 Gaiser ..... 210/488
6,338,444 B1 1/2002 Swan
6,712,293 B2 3/2004 Swan

FOREIGN PATENT DOCUMENTS

EP 0271316 6/1998
GB 2 121 318 A 12/1983

* cited by examiner

SPRAY NOZZLE APPARATUS AND METHOD

BACKGROUND OF THE INVENTION

Spray nozzles, or tips, can be used to apply liquid solutions of agro-chemicals and fertilizers. For example, several spray nozzles can be used to apply pesticides or other chemicals to a farm field. The nozzle configuration can have a significant impact on the type of spray pattern that is produced, which affects the amount of coverage that is achieved by each nozzle. Fan spray nozzles can widen a stream of liquid into a fan by passing the liquid through a slotted end. Deflector style nozzles can produce a spray pattern by forcing a stream of liquid against a deflector plate. Each configuration can exhibit different characteristics. For example, the way that a nozzle is configured can impact the reliability and reproducibility of the spray stream.

SUMMARY OF THE INVENTION

In one embodiment, a spray nozzle for spraying liquid can include a body, a spray orifice, a filter, and an insert. The body can have a spray outlet portion, and the spray outlet portion can terminate in a substantially spherical dome. The spray orifice can be included in the spray outlet portion and can be positioned before the substantially spherical dome in a flow path. The spray orifice can also be substantially V-shaped. The filter can be at least partially positioned within the body. The insert can be positioned at least partially in the spray outlet portion and can include an entry shaft having a substantially rectangular cross section. The insert can also include one or more projections.

In some embodiments, a method of spraying liquid from a spray nozzle can include receiving the liquid in a body of the spray nozzle, filtering the liquid with a filter, creating turbulence in the liquid using one or more projections in an entry shaft of a flow control insert, introducing air into the liquid using an air gap within the flow control insert, and dispersing the liquid using a spray orifice. The filter can be received by the body of the spray nozzle. The entry shaft of the flow control insert can have a substantially rectangular cross section. The spray orifice can be positioned before a spherical dome in a flow path, and the spray orifice can be substantially V-shaped.

Other embodiments will become apparent by consideration of the detailed description and accompanying drawings.

DETAILED DESCRIPTION

Figure 1:
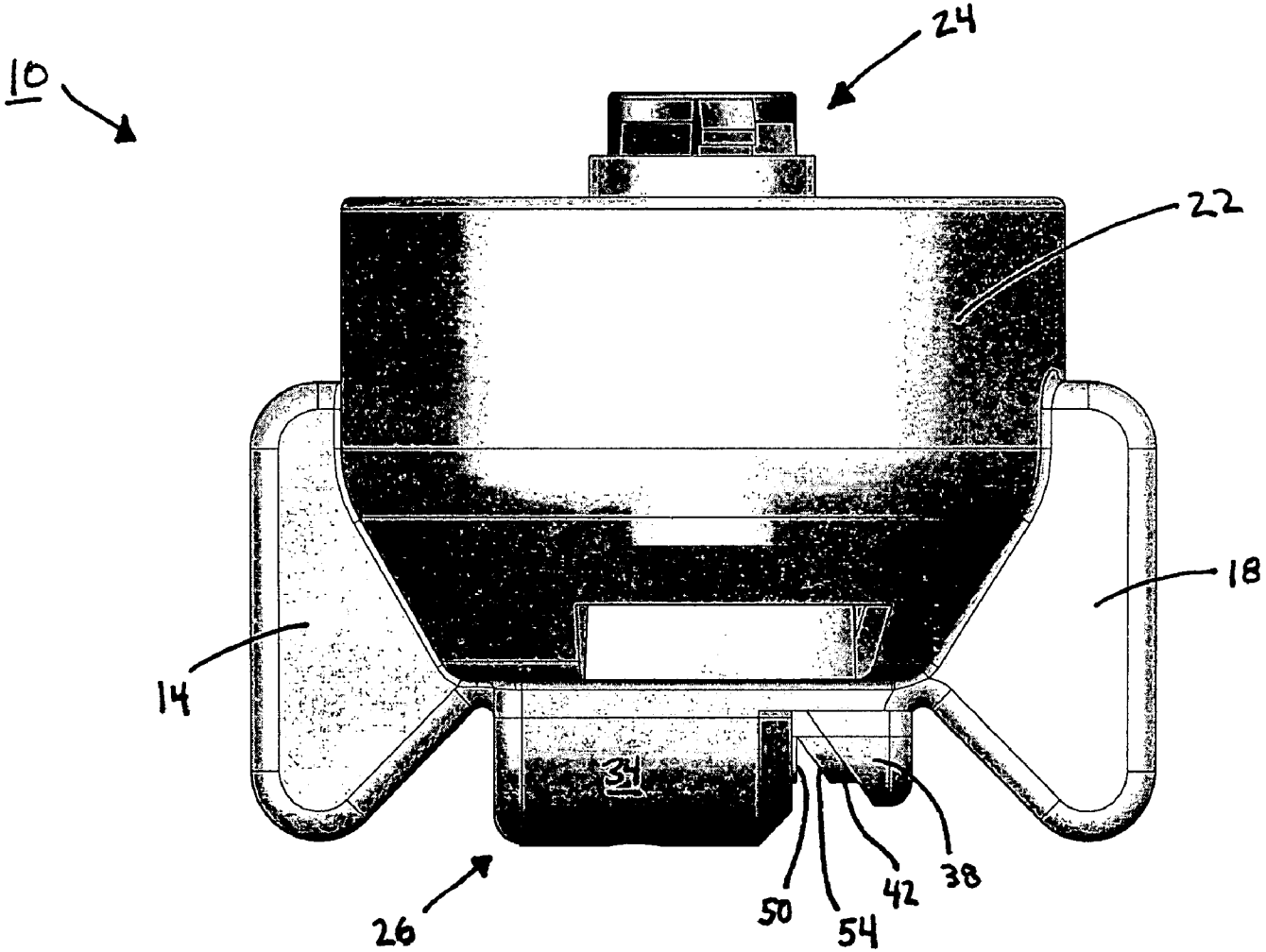
FIG. 1 is a side view of a spray nozzle according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-5A illustrate a spray nozzle 10 according to one embodiment of the invention. The spray nozzle 10 can be used for dispersing liquid agricultural solutions (e.g., herbicide, pesticide, fertilizer, fungicide, insecticide, etc.) over a farm field or for other liquid spraying applications. The spray nozzle 10 can include wings 14 and 18, a nozzle body 22, a filter 24, and a spray outlet portion or tube 26. In some embodiments, the wings 14 and 18, the nozzle body 22, and the spray outlet tube 26 can be molded, or similarly constructed, into a single component. However, the spray nozzle 10 can be constructed of separate components that are assembled together. In some embodiments, the spray nozzle 10 can include only a single wing.

The spray nozzle 10 can be coupled to a host holder (not shown), that can provide liquid from a liquid supply (e.g., a holding tank). The spray nozzle 10 can be coupled to the host holder by inserting the host holder into the spray nozzle 10 and turning the spray nozzle 10 counter-clockwise by gripping the wings 14 and 18. Alternatively, the spray nozzle 10 can be coupled to the host holder using a clockwise turn. In some embodiments, the spray nozzle 10 can be secured to the host holder with a snap-fit after being rotated. Rotating the spray nozzle 10 until it is secured to the host holder can aid in correctly orienting a spray stream. For example, rotating the spray nozzle 10 until a snap-fit is achieved can automatically align the spray stream in the proper direction.

Figure 2:
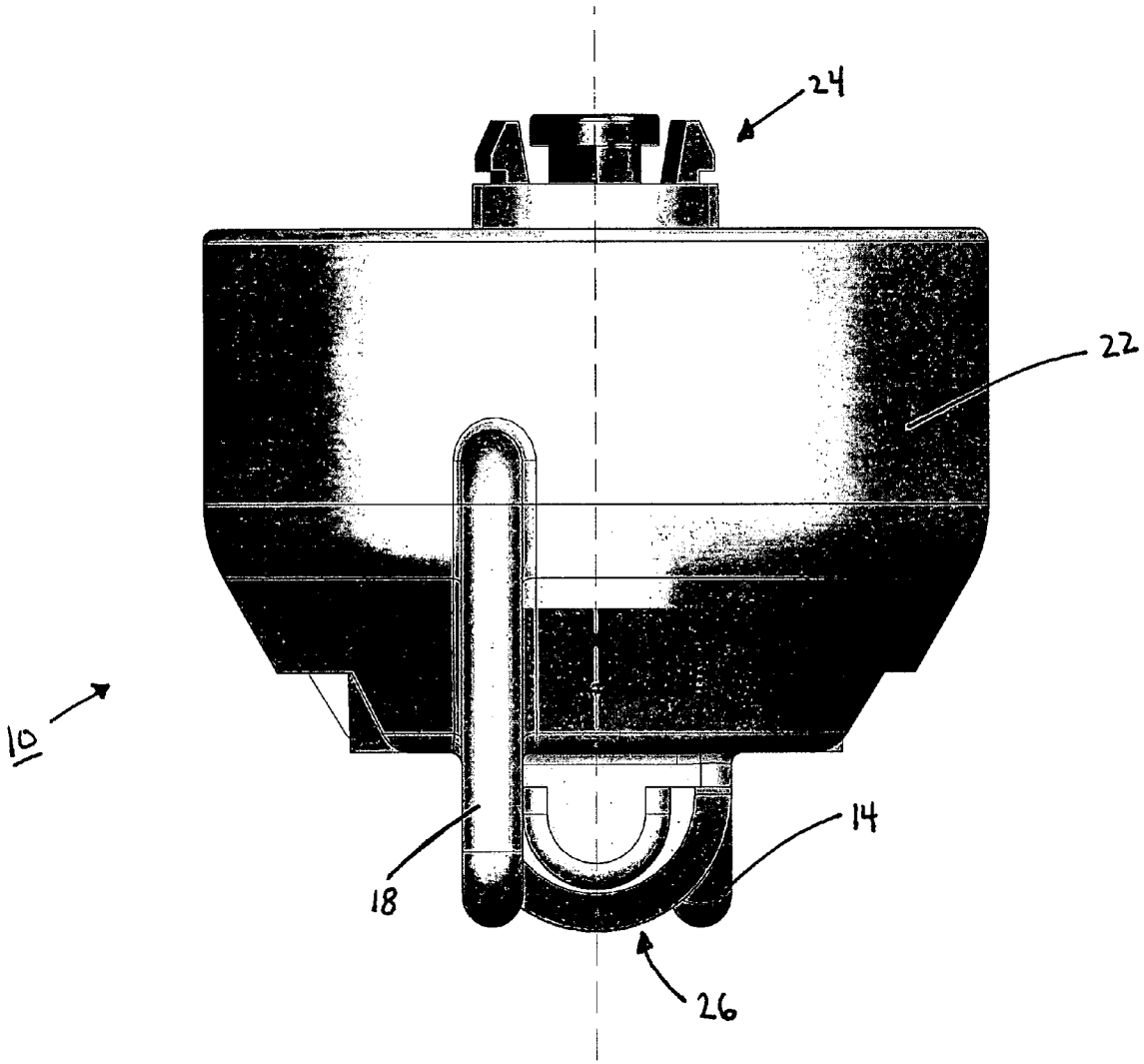
FIG. 2 is a front view of the spray nozzle of FIG. 1.

The wings 14 and 18 can be offset with respect to each other (i.e., not aligned axially), as shown in FIG. 2. This offset orientation can allow components of the spray nozzle 10 to be assembled without interference from the wings 14 and 18. For example, in some embodiments, a flow control pin (as shown and described with respect to FIGS. 4A-5B) can be inserted into the spray outlet tube 26 before using the spray nozzle 10. Offsetting the wings 14 and 18 can allow the bottom of the wings 14 and 18 to approximately coincide with the bottom of the spray outlet tube 26, while providing room for the flow control pin to be inserted. Such an arrangement can reduce the overall height of the spray nozzle 10.

The filter 24 can be used to prevent foreign material (e.g., debris, solid particles, etc.) from passing through the spray nozzle 10. Such materials may block the flow or disrupt the spray pattern of the spray nozzle 10, requiring removal the spray nozzle 10 for cleaning or replacement of the spray nozzle 10. In some embodiments, the filter 24 can include a separate filter body and filtering material, as shown and described with respect to FIG. 4.

Figure 3:
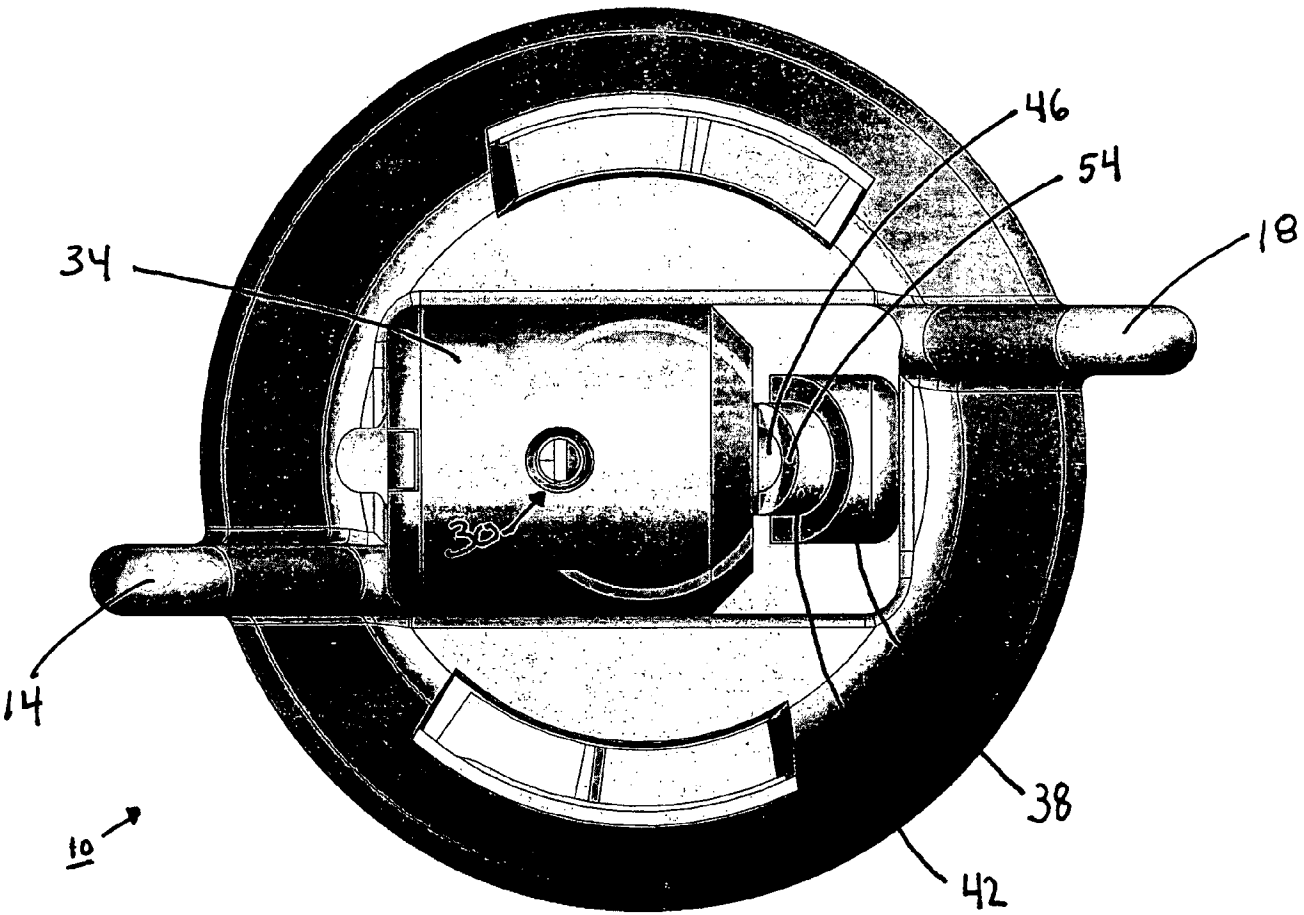
FIG. 3 is a bottom view of the spray nozzle of FIG. 1.

The spray outlet tube 26 can include separate portions of varying diameter. As shown in FIGS. 1 and 3, in some embodiments, the spray outlet tube 26 can include three portions having three different diameters. For example, a main portion 34 of the spray outlet tube 26 can have the relatively largest diameter. An outlet portion 38 can be positioned at one end of the main portion 34 and can have a relatively smaller diameter than the main portion 34. Additionally, a stepped-down portion 42 can be positioned within an intermediate section and can have a relatively smaller diameter than the outlet portion 38. A spray orifice 46 can be "notched" out of the stepped-down portion 42 and can include a vertical edge 50 and an angled edge 54. The angled edge 54 of the spray orifice 46 can be altered according to the desired spray pattern of the spray nozzle 10. For example, increasing the angle of the angled edge 54 can increase the width of a spray pattern. The spray that is produced by the spray orifice 46 can be angled forward or rearward and can depend on the attachment of the spray nozzle 10 to the host device. For example, in some embodiments, the spray nozzle 10 can be attached to the host device using a half (i.e., 180 degree) turn or rotation. As a result, the user can choose between a forward angled spray orientation and rearward angled spray orientation, each orientation being positioned 180 degrees from each other, in order to provide the best coverage.

FIG. 3 also illustrates an air intake opening 30. As described in greater detail with respect to FIG. 5, the air intake opening 30 can be used to introduce air into the liquid before dispersing the liquid. Introducing air into the liquid stream can result in the production of relatively larger spray droplets that contain air bubbles. Increasing the size of the droplets by adding air can reduce the number of relatively small droplets (e.g., less than 200 microns) that are dispersed by the spray nozzle 10. Fewer larger air-charged (or aerated) droplets can provide similar coverage to more smaller droplets due to the contact characteristics of the larger air-charged droplets. For example, the air-charged or aerated droplets can explode when they contact a surface (e.g., a plant) and spread numerous smaller droplets over the entire surface.

Figure 4B:
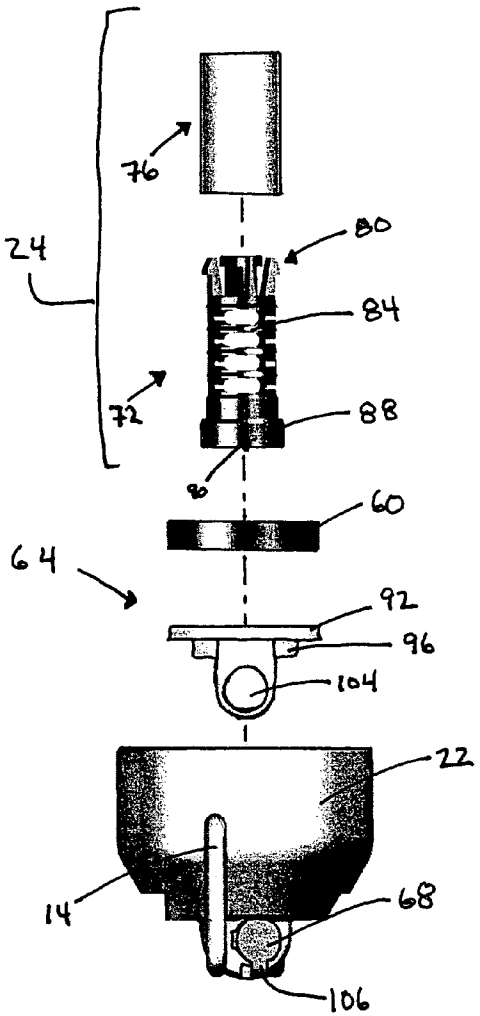
FIG. 4B is an exploded front view of the spray nozzle of FIG. 1.
Figure 4A:
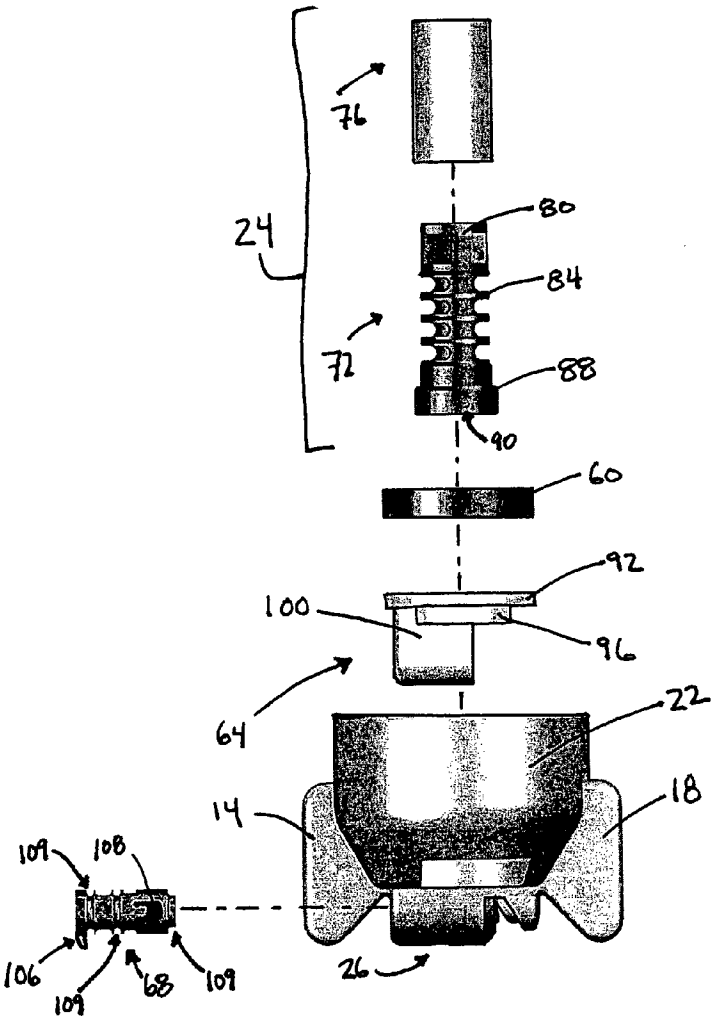
FIG. 4A is an exploded side view of the spray nozzle of FIG. 1.

FIGS. 4A and 4B illustrate the internal and external components of the spray nozzle 10, which can include the filter 24, a sealing ring 60, a filter coupling insert 64, the nozzle body 22, the spray outlet tube 26, and a flow control insert or "venturi" insert 68. In other embodiments, the spray nozzle 10 can include more or fewer components than those shown. For example, in one embodiment, the filter coupling insert 64 and the flow control insert 68 can be combined into a single component.

The filter 24 can include a filter body 72 and a filter material 76. In some embodiments, the filter material 76 can be positioned to substantially surround the filter body 72 when the filter 24 is assembled. The filter material 76 can be retained by the filter body 72 using retaining protrusions 80, which can extend out and over the end of the filter material 76, as shown in FIGS. 1 and 2. In some embodiments, the filter material 76 can be a wire mesh having holes sized to allow liquid to pass through. However, the holes of the wire mesh can also be small enough that they do not allow foreign material to pass through. In other embodiments, the filter material 76 can be a gauze material, a molded plastic gauze material, or a slotted plastic cylinder. Other suitable types of materials can also be used for the filter material 76. The filter body 72 can include one or more filter body rings 84 connected to a base 88. The space between each of the filter body rings 84 can create one or more openings, which can allow fluid to pass through the filter body 72. The base 88 of the filter body 72 can be sized so that it can be coupled to the filter coupling insert 64.

The sealing ring 60 can be rubber, or a similar material, that has the ability to create a fluid-tight seal. As shown in FIGS. 4A and 4B, the sealing ring 60 can be positioned adjacent to the filter coupling insert 64 and around the base 88 of the filter body 72 when the spray nozzle 10 is assembled. During use, the sealing ring 60 can be compressed between the host holder and the filter coupling insert 64 and can be used to prevent liquid from escaping between the host holder and the nozzle body 22.

As shown in FIGS. 4A and 4B, the filter coupling insert 64 can include an outer ring 92, a main opening 96, and an outlet 100. In some embodiments, the filter coupling insert 64 can be a standard-sized component that can be used with a variety of nozzles. The outer ring 92 can have a width that is substantially the same as the width of the sealing ring 60. As a result, the outer ring 92 can provide a support surface for the sealing ring 60. The main opening 96 can be generally circular and can be sized to receive the base 88 of the filter body 72. In some embodiments, the base 88 of the filter body 72 can be received by the main opening 96 (of the filter coupling insert 64) with a snap-fit, so that the outer edge of the base 88 can engage with an edge of the main opening 96, and a bottom of the base 88 can contact a surface of the main opening 96. In some embodiments, the base 88 of the filter body 72 can include nodules 90 that aid in connecting the filter 24 to the filter coupling insert 64. The outlet 100 can include a passage that allows the liquid to pass from the filter coupling insert 64 to the flow control insert 68. As a result, the liquid can be substantially isolated from air chambers that may be otherwise created by the nozzle body 22. As shown in FIG. 4B, the filter coupling insert 64 can also include a flow control insert opening 104, which can allow the flow control insert 68 to be inserted into the filter coupling insert 64 when the spray nozzle 10 is assembled.

The flow control insert 68 can include a tab 106 that can help to properly align the flow control insert 68 with the spray outlet tube 26. In some embodiments, the flow control insert 68 can also include a movable protrusion 108 that can couple the flow control insert 68 to an inner surface of the flow control insert opening 104 when the spray nozzle 10 is assembled. As a result, the tab 106 and protrusion 108 of the flow control insert 68 can automatically align and secure the flow control insert 68 to the spray outlet tube 26 and the filter coupling insert 64, respectively. In some embodiments, the flow control insert 68 can also include sealing grooves 109 that can receive sealing rings. The sealing grooves 109 can be annular grooves that can allow sealing rings (not shown) to be coupled to the flow control insert 68. The sealing rings can help to create several fluid-tight seals along the length of the flow control insert 68, so that liquid does not escape between the flow control insert 68 and the filter coupling insert 64 when the nozzle 10 is assembled.

Upon assembly, the body 22 of the spray nozzle 10 can receive the filter coupling insert 64, the filter 24, and the sealing ring 60. As a result, the body 22 can at least partially surround the combination of the filter 24, the sealing ring 60, and the filter coupling insert 64 (as shown in FIG. 1). In some embodiments, the body 22 of the spray nozzle 10 can include a support lip (as shown and described with respect to FIG. 5) that is sized to contact and support the outer ring 92 of the filter coupling insert 64. Additionally, the flow control insert opening 104 of the filter coupling insert 64 can be positioned within the spray outlet tube 26. As a result, the flow control insert 68 can be inserted into the spray outlet tube 26 (and within an interior space defined by the flow control insert opening 104).

Figure 5B:
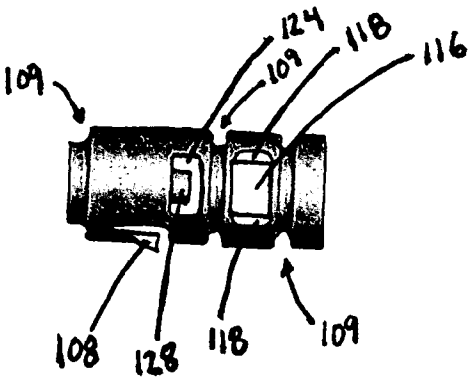
FIG. 5B is a top view of a spray nozzle insert according to one embodiment of the invention.
Figure 5A:
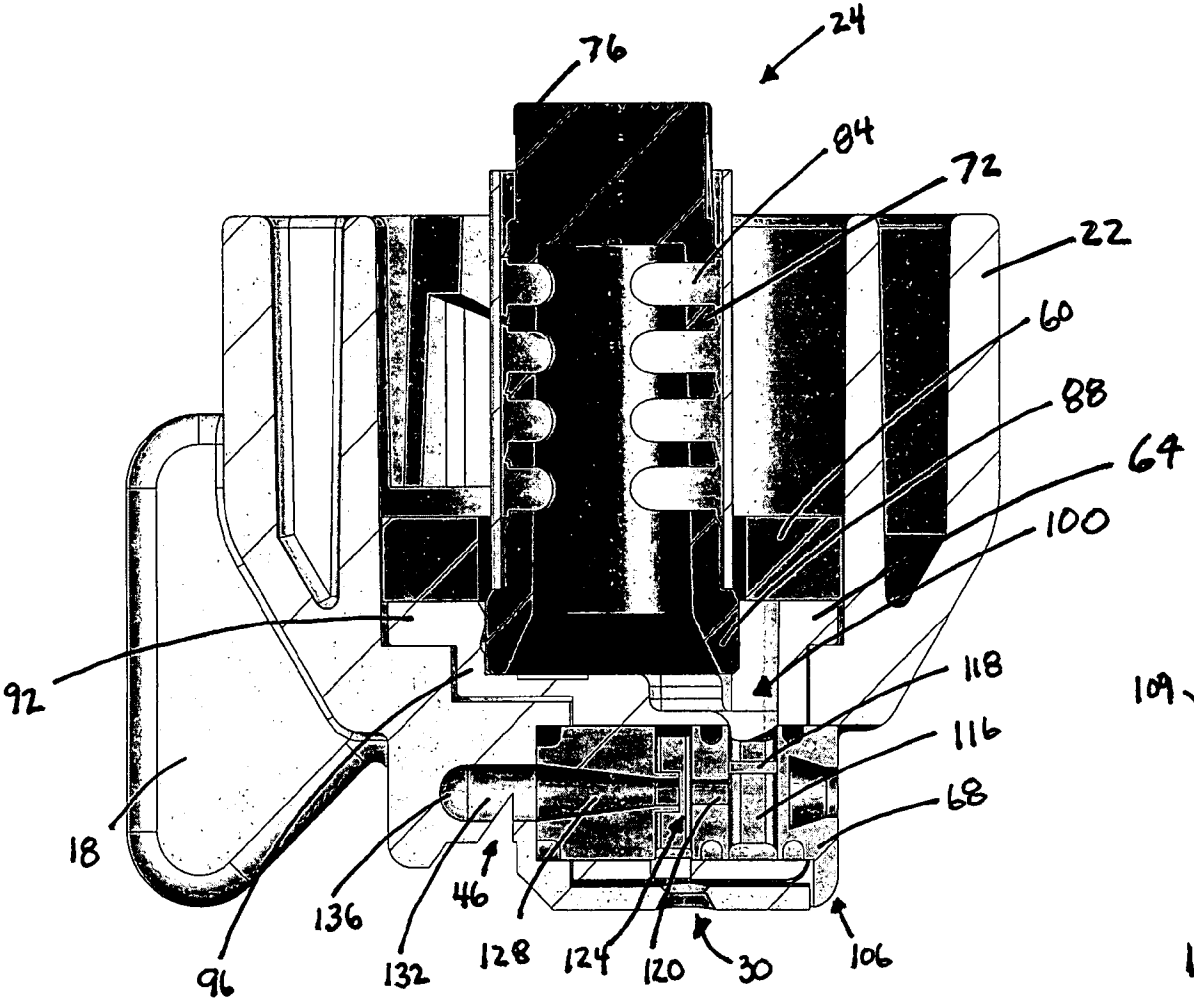
FIG. 5A is a cross-sectional side view of the spray nozzle of FIG. 1.

FIG. 5A illustrates the interior of an assembled spray nozzle 10. During use, the liquid can flow into the body 22, and through the filter 24 and the filter material 76 in the entry portion of the body 22. After passing through the filter material 76, the liquid can flow through the base 88 of the filter body 72. The sealing ring 60 can prevent liquid from passing directly to the main opening 96 of the filter coupling insert 64 without first passing through the filter 24. After passing through the base 88 of the filter body 72, the liquid can contact a bottom surface of the main opening 96 and pressure can force the liquid down through the outlet 100 of the filter coupling insert 64. After passing through the outlet 100, the liquid can enter the flow control insert 68.

As shown in FIG. 5A, the flow control insert 68 can include an entry shaft 116, a primary tube 120, an air gap 124, and a secondary tube 128. Upon entering the flow control insert 68, the liquid can flow down the entry shaft 116. In some embodiments, the entry shaft 116 can have a generally rectangular cross-section, which can affect the flow characteristics of the liquid before entering the primary tube 120. Additionally, the entry shaft 116 can include one or more projections or ledges 118 that can be positioned above the primary tube 120. In other embodiments, more or fewer ledges 118 can be included (e.g., one, three, etc.). The entry shaft 116 and the generally rectangular ledges 118 are also shown in FIG. 5B. The ledges 118 can induce turbulence in the liquid flow while the liquid travels down the entry shaft 116. As a result, the entry shaft 116 and ledges 118 can prepare the flow of liquid prior to the liquid entering the primary tube 120. In some embodiments, such flow preparation can allow air to be more easily introduced to the liquid.

After flowing down the entry shaft 116 and over the ledges 118, the liquid can be forced into the primary tube 120, which can be arranged substantially perpendicular to the entry shaft 116. Upon exiting the primary tube 120, the liquid can pass over the air gap 124, where air can be introduced. Air can be drawn into the air gap 116 through the air opening 30 at the bottom of the spray outlet tube 26. After passing over the air gap 124, the air-charged liquid can be forced into the secondary tube 128. In some embodiments, the cross-sectional area of an entry portion of the secondary tube 128 is generally smaller than an exit portion of the secondary tube 128.

The liquid can exit the flow control insert 68 and continue into an exit passage 132 of the spray outlet tube 26. In some embodiments, the exit passage 132 of the spray outlet tube 26 can terminate in a generally dome shaped portion 136. The spray orifice 46 can be cut into the exit passage 132 before the dome-shaped termination portion 136 in the liquid flow path. As a result, a portion of the liquid can contact the dome-shaped portion 136 before being dispersed, while the remainder of the liquid can be dispersed directly. The spray orifice 46 can be a generally "V-shaped" slot that includes a vertical edge and an angled edge. In some embodiments, positioning the V-shaped spray orifice before the dome-shaped portion 136 in the liquid flow path in the exit passage 132 can produce a fan-type spray pattern. The fan-type spray pattern can be altered according to the spray and configuration of the exit passage 132, as well as the angle of the V-shaped exit orifice 46.

Various features and advantages of the invention are set forth in the following claims.

The invention claimed is:

1. A spray nozzle for spraying liquid, the spray nozzle comprising:

a body having a spray outlet portion;

a spray orifice included in the spray outlet portion;

a filter at least partially positioned within the body; and an insert positioned at least partially in the spray outlet portion, the insert including a primary tube and a secondary tube, the secondary tube directly coupled to the spray orifice;

the filter positioned upstream from the secondary tube, the filter positioned perpendicular to the secondary tube;

the insert including an entry shaft having a substantially rectangular internal cross section, the entry shaft including at least one projection, the entry shaft positioned upstream from the primary tube and downstream from the filter.

2. The spray nozzle of claim 1, wherein the at least one projection creates turbulence in the liquid.

3. The spray nozzle of claim 2, wherein the at least one projection is substantially rectangular in shape.

4. The spray nozzle of claim 1, wherein the spray orifice includes at least a first side and a second side, the first side substantially perpendicular to the body, and the second side positioned at an angle with respect to the body.

5. The spray nozzle of claim 1, wherein the spray orifice creates a forward-angled fan spray.

6. The spray nozzle of claim 1, wherein the liquid is at least one of herbicide, pesticide, insecticide, fungicide, and fertilizer.

7. The spray nozzle of claim 1, wherein the insert includes an air gap that introduces air into the liquid.

8. The spray nozzle of claim 1, wherein the insert includes an alignment tab that contacts the body and aligns the insert.

9. The spray nozzle of claim 1, wherein the body includes a first wing offset from a second wing.

10. The spray nozzle of claim 9, wherein a first bottom portion of at least one of the first wing and the second wing is aligned with a second bottom portion of the spray outlet portion.

11. The spray nozzle of claim 1, wherein the filter includes a filter body and a filter material.

12. The spray nozzle of claim 11, wherein the filter material is one of a wire mesh and a gauze material.

13. The spray nozzle of claim 1, further comprising a sealing ring positioned within the body.

14. A spray nozzle for spraying liquid, the spray nozzle comprising:

a body having a spray outlet portion;

a spray orifice included in the spray outlet portion;

a filter coupling insert received by the body;

a filter releasably coupled to the filter coupling insert; and a flow control insert coupled to the filter coupling insert, the flow control insert including a primary tube and a secondary tube, the secondary tube coupled directly to the spray orifice, the filter and the filter coupling insert positioned upstream from the secondary tube, the filter and the filter coupling insert positioned perpendicular to the secondary tube, the filter and the filter coupling insert being independent from the flow control insert so that the flow control insert is removeable from the body without removing the filter from the body.

15. The spray nozzle of claim 14, wherein the at least one projection creates turbulence in the liquid.

16. The spray nozzle of claim 15, wherein the at least one projection is substantially rectangular in shape.

17. The spray nozzle of claim 14, wherein the spray orifice includes at least a first side and a second side, the first side substantially perpendicular to the body, and the second side positioned at an angle with respect to the body.

18. The spray nozzle of claim 14, wherein the spray orifice creates a forward angled fan spray.

19. The spray nozzle of claim 14, wherein the liquid is at least one of herbicide, pesticide, insecticide, fungicide, and fertilizer.

20. The spray nozzle of claim 14, wherein the flow control insert includes an air gap that introduces air into the liquid.

21. The spray nozzle of claim 14, wherein the flow control insert includes an alignment tab that contacts the body and aligns the flow control insert.

22. The spray nozzle of claim 14, wherein the body includes a first wing offset from a second wing.

23. The spray nozzle of claim 22, wherein a first bottom portion of at least one of the first wing and the second wing is aligned with a second bottom portion of the spray outlet portion.

24. The spray nozzle of claim 14, wherein the filter includes a filter body and a filter material.

25. The spray nozzle of claim 24, wherein the filter material is one of a wire mesh and a gauze material.

26. The spray nozzle of claim 14, further comprising a sealing ring positioned within the body.

27. A spray nozzle for spraying liquid, the spray nozzle comprising:

a body having a liquid entry portion and a spray outlet portion;

a spray orifice included in the spray outlet portion;

a filter at least partially positioned within the liquid entry portion; and an insert positioned at least partially in the spray outlet portion and substantially perpendicular to the liquid entry portion, the insert including a primary tube and a secondary tube, the secondary tube coupled directly to the spray orifice, the filter and the insert positioned upstream from the secondary tube, the filter and the insert positioned perpendicular to the secondary tube, the filter being independent from the insert so that the insert is removeable without removing the filter.

28. The spray nozzle of claim 27, wherein the insert includes at least one projection.

29. The spray nozzle of claim 28, wherein the at least one projection creates turbulence in the liquid.

30. The spray nozzle of claim 29, wherein the at least one projection is substantially rectangular in shape.

31. The spray nozzle of claim 27, wherein the insert includes an entry shaft having a substantially rectangular cross section.

32. The spray nozzle of claim 27, wherein the spray orifice includes at least a first side and a second side, the first side substantially perpendicular to the body, and the second side positioned at an angle with respect to the body.

33. The spray nozzle of claim 27, wherein the insert includes an air gap that introduces air into the liquid.

34. The spray nozzle of claim 27, wherein the insert includes an alignment tab that contacts the body and aligns the insert.

* * * * *